US007603730B2

(12) United States Patent
Zelnik

(10) Patent No.: US 7,603,730 B2
(45) Date of Patent: Oct. 20, 2009

(54) APPARATUS FOR SUPPORTING A PATIENT IN A PRONE POSITION DURING DIAGNOSTIC IMAGING

(75) Inventor: Deborah Ruth Zelnik, Haifa (IL)

(73) Assignee: General Electric Company, Schenectady, NY (US)

( * ) Notice: Subject to any disclaimer, the term of this patent is extended or adjusted under 35 U.S.C. 154(b) by 384 days.

(21) Appl. No.: 11/481,627

(22) Filed: Jul. 6, 2006

(65) Prior Publication Data

US 2008/0005840 A1 Jan. 10, 2008

(51) Int. Cl.

| | |
|---|---|
| ***A61G 13/12*** | (2006.01) |
| ***A61B 6/04*** | (2006.01) |
| ***A47C 16/00*** | (2006.01) |
| ***A47C 20/00*** | (2006.01) |

(52) U.S. Cl. ..... 5/601; 5/621; 5/622; 5/623; 5/632; 378/208

(58) Field of Classification Search ..... 5/601, 5/600, 621–623, 632, 638, 643, 646, 661, 5/655.9, 953; 378/208, 209, 20
See application file for complete search history.

(56) References Cited

U.S. PATENT DOCUMENTS

| | | | | | |
|---|---|---|---|---|---|
| 1,134,720 | A | * | 4/1915 | Bradley | 5/622 |
| 3,608,103 | A | * | 9/1971 | Seid | 5/661 |
| 3,694,831 | A | | 10/1972 | Treace | |
| 3,808,615 | A | * | 5/1974 | Geary | 5/622 |
| 3,874,010 | A | * | 4/1975 | Geary | 5/610 |
| 4,074,374 | A | * | 2/1978 | Ayesh | 5/400 |
| 4,722,328 | A | * | 2/1988 | Scott et al. | 606/245 |
| 4,730,801 | A | | 3/1988 | Cloward et al. | |
| 4,850,343 | A | * | 7/1989 | Scott | 606/245 |
| 5,054,142 | A | * | 10/1991 | Owens | 5/633 |
| 5,192,306 | A | * | 3/1993 | Scott et al. | 606/243 |
| 5,214,814 | A | | 6/1993 | Eremita et al. | |
| 5,362,302 | A | * | 11/1994 | Jensen et al. | 601/24 |
| 5,408,713 | A | * | 4/1995 | Stratton et al. | 5/632 |
| 5,410,769 | A | | 5/1995 | Waterman | |

(Continued)

FOREIGN PATENT DOCUMENTS

| | | |
|---|---|---|
| EP | 0660694 B1 | 11/1997 |

(Continued)

OTHER PUBLICATIONS

EarthGear™ therapeutic innovations, Pinnacle, www.earthgearcom, 1 pg.

(Continued)

*Primary Examiner*—Robert G Santos
(74) *Attorney, Agent, or Firm*—The Small Patent Law Group; Dean D. Small

(57) ABSTRACT

A patient positioning apparatus to support a patient in a prone position on a patient table during a diagnostic imaging scan comprises a head support and an arm support. The head support is configured to extend above the patient table and supports a patient's head above a table top of the patient table while the patient lies on the patient table in a prone position. The arm support is joined to the head support and is configured to extend below the patient table to support a patient's forearms below the patient table.

22 Claims, 5 Drawing Sheets

U.S. PATENT DOCUMENTS

| | | | | |
|---|---|---|---|---|
| 5,423,861 | A * | 6/1995 | Kelley | 606/241 |
| 5,466,039 | A * | 11/1995 | Umbrianna | 297/116 |
| 5,537,702 | A | 7/1996 | Brown-Milants et al. | |
| 5,661,860 | A * | 9/1997 | Heitz | 5/632 |
| 5,678,266 | A * | 10/1997 | Petringa et al. | 5/655.5 |
| 5,771,512 | A | 6/1998 | Kurakake et al. | |
| 5,782,244 | A | 7/1998 | Kostich | |
| 5,893,183 | A * | 4/1999 | Bechtold, Jr. | 5/632 |
| 6,684,431 | B2 * | 2/2004 | Splane, Jr. | 5/657 |
| 6,718,581 | B2 * | 4/2004 | Riach | 5/632 |
| 6,758,447 | B2 * | 7/2004 | Tinsley | 248/118 |
| 7,555,794 | B2 * | 7/2009 | Zelnik et al. | 5/632 |
| 2002/0100846 | A1 * | 8/2002 | Tinsley | 248/118 |
| 2002/0184706 | A1 * | 12/2002 | Riach | 5/632 |
| 2003/0084512 | A1 | 5/2003 | Fujita et al. | |
| 2003/0084513 | A1 * | 5/2003 | Splane, Jr. | 5/657 |
| 2005/0066444 | A1 | 3/2005 | Mazzei et al. | |
| 2007/0053502 | A1 * | 3/2007 | Zelnik et al. | 378/204 |
| 2008/0005840 | A1 * | 1/2008 | Zelnik | 5/601 |
| 2008/0005841 | A1 * | 1/2008 | Zelnik et al. | 5/601 |

FOREIGN PATENT DOCUMENTS

| | | |
|---|---|---|
| WO | WO 01/49223 A1 | 7/2001 |

OTHER PUBLICATIONS

Sinmed Radiotherapy products, Sinmed Poly-ethylene cushions, www.sinmed.nl, copyright 2003, 1 pg.
Siemens medical, e.cam Signature Series Manual, 8 pgs.
cfi Medical Solutions contour fabricators, inc. Manual, 45 pgs.
Oakworks® Medical Equipment, www.oakworksmed.com, 4pgs.
Banner Therapy Products, "Prone Pillow Pad", www.bannertherapy.com, 2 pgs.
Banner Therapy Products, "Prone Pillow by Chatt", www.bannertherapy.com, 2 pgs.
Banner Therapy Products, "Prone Pillow—MaxRelax", www.bannertherapy.com, 2 pgs.
Sinmed Radiotherapy products, "Posirest", www.sinmed.nl, 2 pgs.
Nuclear Medicin Instruments & Accessories, Catalog 28, Pinestar Technology, Inc., 134 pgs.

* cited by examiner

APPARATUS FOR SUPPORTING A PATIENT IN A PRONE POSITION DURING DIAGNOSTIC IMAGING

BACKGROUND OF THE INVENTION

This invention relates generally to apparatus for positioning a patient during a medical imaging procedure, and more particularly, to apparatus for positioning a patient in a prone position during a medical imaging procedure.

Diagnostic images of a patient are acquired using one or more modalities, such as Nuclear Medicine (NM), Computed Tomography (CT), Magnetic Resonance (MR), Positron Emission Tomography (PET), X-ray and Ultrasound. Some procedures for imaging anatomy, particularly within the torso, require the patient to lie prone on a patient table for a length of time without moving. In some cases, for example during nuclear imaging, an examination may last for an extended duration and thus patient comfort is advantageous. In other cases, such as during nuclear imaging, patient motion may create image artifact, degraded image quality or the necessity to repeat the data acquisition.

The patient table is often narrow to allow the imaging detector(s) to move close to the patient, such as in NM, or to move into a small bore, such as with PET and CT. When lying on the patient table in the prone position, the patient's arms are placed up and away from the body to avoid interference with the motion of the detectors around the patient's torso (in NM) and to avoid placement between the imaging detector(s) and the anatomy of interest. For example, the patient may place their head on their folded arms, looking either down at the table or to the side. Alternatively, the patient may lie with their neck extended to look forward. These positions cause neck strain and patient motion, as well as potentially limiting the breathing space and contributing to feelings of claustrophobia in some patients. Thus, the prone position is not ergonomic and can be difficult, uncomfortable, and/or painful to hold for the length of time necessary to acquire the scan, and patient movement may cause artifacts and blurring of the image.

Placing the arms on the table to the side of the body causes the effective width of the body to be enlarged—preventing movement of the detectors to within close proximity of the torso. In NM, this causes image quality degradation as image quality decreases with increased distance between the imaged organ and the detector. Moreover, the arms, and specifically the large bones in the arms, cause signal reduction due to absorption of photons in NM, PET and CT. Additionally, the arms may cause artifacts due to the absorption of photons in NM, PET and CT.

Therefore, a need exists for a positioning apparatus to comfortably position a patient in a prone position on the patient table. Certain embodiments of the present invention are intended to meet these needs and other objectives that will become apparent from the description and drawings set forth below.

BRIEF DESCRIPTION OF THE INVENTION

In one embodiment, a patient positioning apparatus to support a patient in a prone position on a patient table during a diagnostic imaging scan comprises a head support and an arm support. The head support is configured to extend above the patient table and supports a patient's head above a table top of the patient table while the patient lies on the patient table in a prone position. The arm support is joined to the head support and is configured to extend below the patient table to support a patient's forearms below the patient table.

In another embodiment, a patient positioning apparatus to support a patient in a prone position on a patient table during a diagnostic imaging scan comprises a head support supporting a patient's head above a top surface of a patient table. An arm support supports a patient's arms below a bottom surface of the patient table. At least first and second legs interconnect the head support and the arm support. The at least first and second legs extend proximate outer edges of the patient table and have an above table portion and a below table portion. The above table portion extends above the top surface of the patient table and is interconnected with the head support. The below table portion extends below a bottom surface of the patient table and is interconnected with the arm support.

In another embodiment, a patient positioning apparatus to support a patient in a prone position on a patient table comprises a head support and an arm support. The head support supports a patient's head above a top surface of a patient table and comprises a curved face support having an opening in the center thereof. The arm support supports a patient's arms below the patient table. The arm support extends substantially parallel to the patient table and comprises a tray configured to support the patient's arms beyond outer side edges of the patient table. First and second legs hold the head and arm supports with respect to each other and are attachable to the side edges of the patient table.

The foregoing summary, as well as the following detailed description of certain embodiments of the present invention, will be better understood when read in conjunction with the appended drawings. It should be understood that the present invention is not limited to the arrangements and instrumentality shown in the attached drawings.

DETAILED DESCRIPTION OF THE INVENTION

Figure 1:
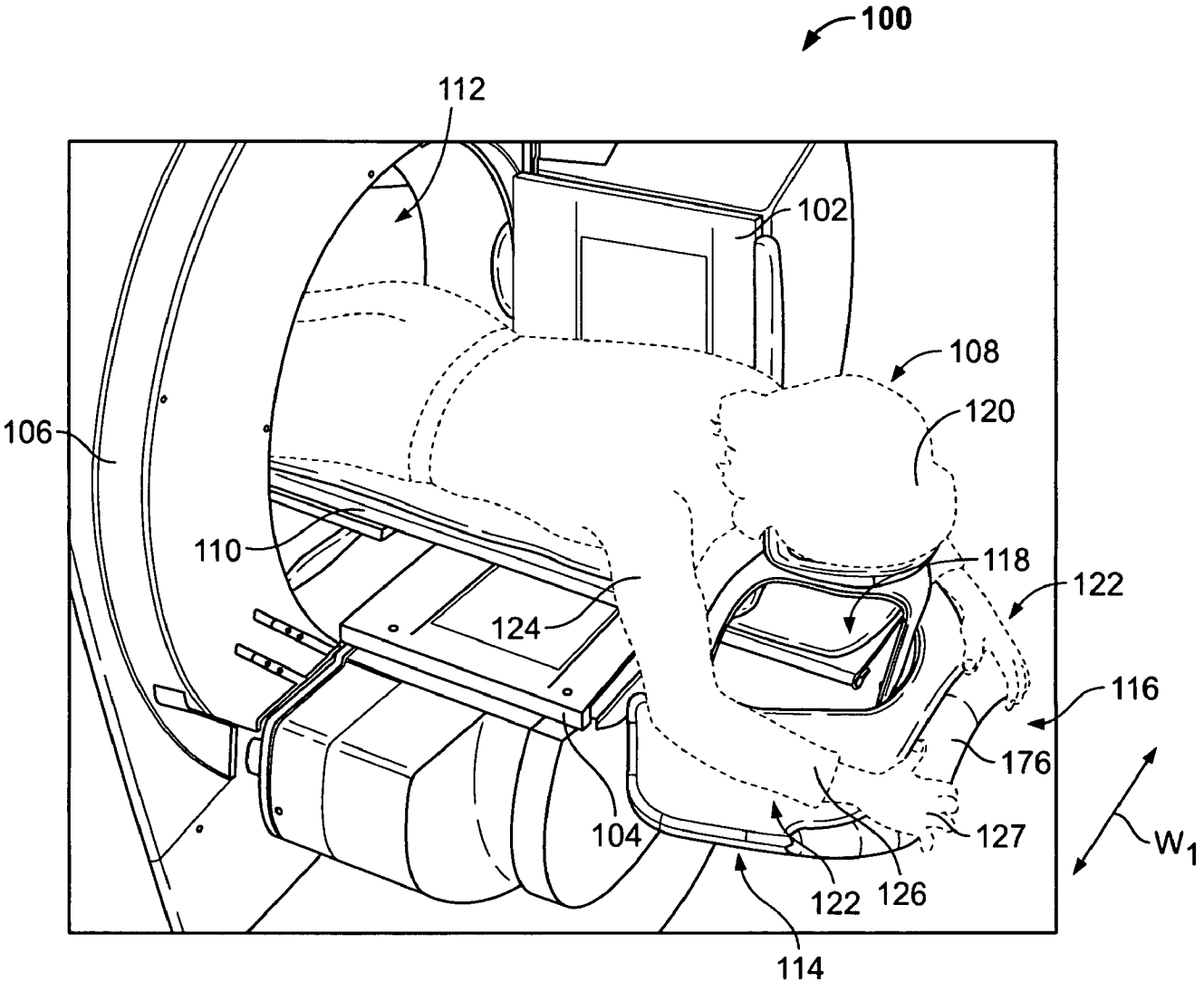
FIG. 1 illustrates an imaging system with a prone patient positioned with a positioning apparatus on a patient table in accordance with an embodiment of the present invention.

FIG. 1 illustrates an imaging system 100 with a patient 108 in a prone position on a patient table 110. Positioning apparatus 114 supports and holds the patient's head 120 and arms 122 while in the prone position. The patient 108 is facing a table top 118 of the patient table 110 with their arms 122 positioned away from their torso. In the exemplary illustration, the imaging system 100 is an NM system having first and second imaging detectors 102 and 104 mounted on a gantry 106. It should be understood that other diagnostic imaging modalities may be used, such as CT, MR and multi-modality systems. The patient table 110 extends through an opening 112 in the gantry 106 and is narrow in width W1 to allow the first and second detectors 102 and 104 to be as close to the patient 108 as possible when acquiring diagnostic data.

The prone patient positioning apparatus 114 is removably mounted to a first end 116 of the patient table 110. The positioning apparatus 114 elevates the patient's head 120 above the table top 118 of the patient table 110 to allow room between the patient's face and the table top 118 to breathe. The patient 108 maintains their neck in a straight position, that is, the neck is not extended to look forward or twisted to either side. Alternatively, the patient 108 may choose to lie with their head 120 turned to look to one side while being supported by the positioning apparatus 114 if that position affords more comfort.

The positioning apparatus 114 supports the patient's arms 122 below the patient table 110. The positioning apparatus 114 is large enough to accommodate different sizes of patients and multiple arm positions, allowing the patient 108 to find a comfortable and ergonomic position. For example, the patient's arms 122 may be positioned such that upper arm 124 is substantially perpendicular to the floor of the room or a horizontal plane of the patient table 110, while forearm 126 is placed substantially parallel to the horizontal plane of the patient table 110, with hands 127 resting on a hand rest 176.

Figure 2:
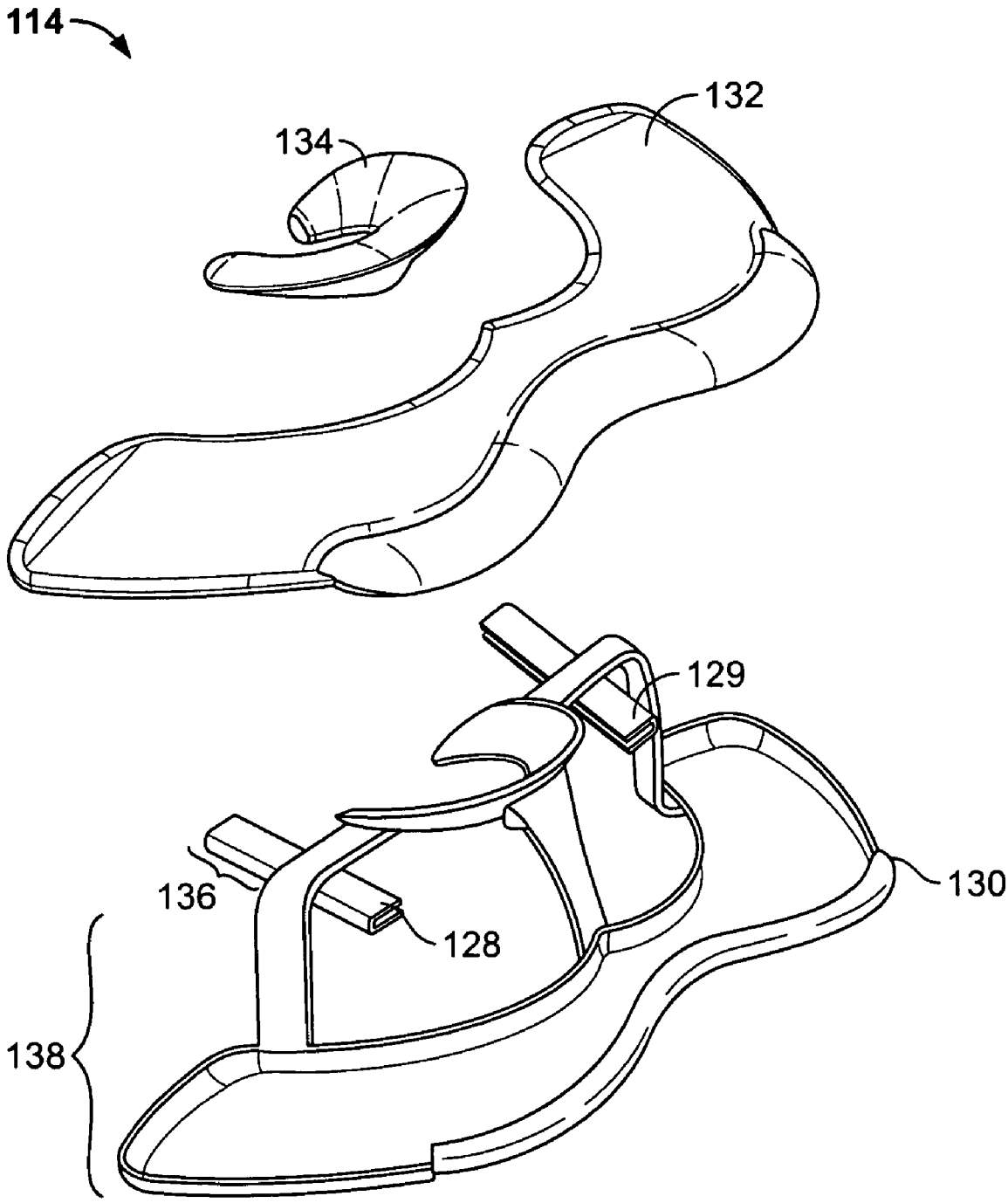
FIG. 2 illustrates an exploded view of the positioning apparatus of FIG. 1 in accordance with an embodiment of the present invention.

FIG. 2 illustrates an exploded view of the positioning apparatus 114 of FIG. 1. A support shell 130 may be formed of a hard and/or firm material such as ethelene, polyethelene, plastic, or composite material. The hard material may be chosen based on properties such as strength, durability and weight. The support shell 130 may be molded and formed as a single piece of material or may be formed of multiple pieces or portions which are joined together. The support shell 130 has integrated first and second slides 128 and 129 which slide over opposite sides of the first end 116 of the patient table 110. Therefore, the support shell 130 has an above table portion 136 above the first and second slides 128 and 129 and a below table portion 138 below the first and second slides 128 and 129. The first and second slides 128 and 129 stabilize the positioning apparatus 114 with respect to the patient table 110.

An arm cushion 132 is provided over portions of the below table portion 138. A head cushion 134 is provided over portions of the above table portion 136. The arm and head cushions 132 and 134 may be attached to the support shell 130 by adhesive, fasteners, or Velcro, for example. The arm and head cushions 132 and 134 may be formed of a soft material such as viscoelastic, foam, memory foam, or other material. The soft material may be chosen based on properties such as patient comfort, softness, support, ability to compress under pressure and conform to any shape, and the like. When weight from the patient 108 rests on the soft material, the soft material compresses and forms an indentation around the anatomy which helps to prevent movement.

A fabric cover (not shown) which may be easily removed and replaced to allow easy cleaning may be used over the soft material. Alternatively, the fabric cover may be fixed to the soft material. Optionally or alternatively, disposable coverings (not shown) which are replaced for each patient may be used over one or both of the arm and head cushions 132 and 134.

Figure 3:
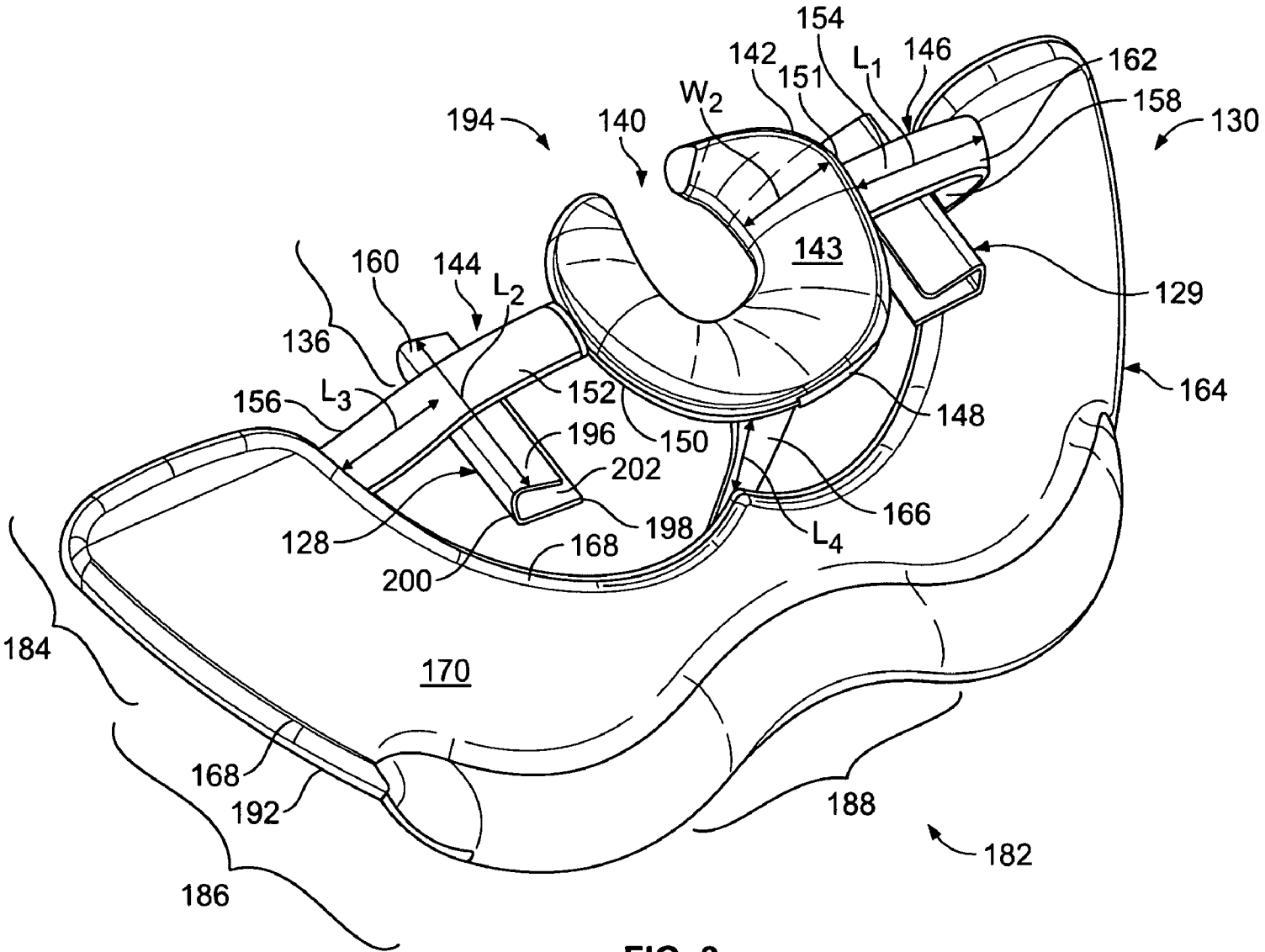
FIG. 3 illustrates the support shell of the positioning apparatus of FIG. 2 in accordance with an embodiment of the present invention.

FIG. 3 illustrates the support shell 130 of the positioning apparatus 114 of FIG. 2. The above table portion 136 has a C-shaped head support 142 with an inner opening 140. The head support 142 has a curved face support 143 with a width W2 which is slanted downwards towards the inner opening 140, providing for the curve of the patient's face resting on the head support 142. The head support 142 receives the head cushion 134 (FIG. 2), which may be held in place by adhesive, Velcro, the weight of the patient's head 120, suction cup, non-skid surface and the like.

First leg 144 has top and side portions 152 and 156 joined by bend 160. Second leg 146 has top and side portions 154 and 158 joined by bend 162. The top portions 152 and 154 extend outwardly from opposite side edges 150 and 151 of the head support 142. Length L1 of each of the top portions 152 and 154 may vary depending on the width W1 (FIG. 1) of the patient table 110. Alternatively, the length L1 of the first and second legs 144 and 146 may be adjustable to accommodate a variety of widths W1 of patient tables 110.

The first and second legs 144 and 146 bend downward at the bends 160 and 162 and the side portions 156 and 158 extend below the patient table 110 to join with arm support 164. The bends 160 and 162 may form an angle of approximately 90 degrees or greater than 90 degrees. Optionally, the bends 160 and 162 may form an angle of less than 90 degrees. Center leg 166 extends from a front edge 148 of the head support 142 to join with the arm support 164. The first and second legs 144 and 146 and center leg 166 hold the head support 142 and arm support 164 in relation to one another. Length L3 of the side portions 156 and 158 and length L4 of the center leg 166 may be fixed. Alternatively, the lengths L3 and L4 may be adjustable to change the relation of the head and arm supports 142 and 164 with respect to each other; that is, to separate the head and arm supports 142 and 164 by greater or lesser distances. Open areas between the head support 142 and the arm support 164, as well as between the first and second legs 144 and 146 and center leg 166, allow room for the patient 108 to breathe as well as receive light from the surrounding area.

The arm support 164 may be curved or form a W shape which extends proximate each side of the first end 116 of the patient table 110. A lip 168 is formed around portions of outer edge 192 to create a shallow tray 170 within the lip 168 which has waves or curves. In other words, the contour of the top of the shallow tray 170 may not be flat. Proximate a rear end 194 of the support shell 130, a rear portion 184 of opposite sides of the tray 170 may tilt or curve upwards towards the patient table 110. Moving towards a front end 182 of the support shell 130, an intermediate portion 186 of the tray 170 may curve downwards away from the patient table 110, and in a center portion 188 the tray 170 may again extend upwards towards the patient table 110.

The first and second slides 128 and 129 are mounted to the first and second legs 144 and 146. Alternatively, the first and second slides 128 and 129 may be formed integral with the side portions 156 and 158. The first and second slides 128 and 129 have a top portion 196, bottom portion 198 and side portion 200 which form an opening 202 there-between. The first and second slides 128 and 129 have a length L2, which may be based on a degree of stability desired or required. The positioning apparatus 114 is slid onto the first end 116 of the patient table 110 so that side edges of the patient table 110 are held in the openings 202, while the top portions 196 of the first and second slides 128 and 129 are in contact with the table top 118. The bottom portions 198 may be in contact with a bottom surface of the patient table 110 or may be separated by a small distance. Optionally, the first and second slides 128 and 129 may be movable and/or adjustable along the side portions 156 and 158 to provide for patient tables 110 of different widths W1. Alternatively, the first and second slides 128 and 129 may be formed without one or both of the bottom portions 198 and side portions 200. Alternatively, the positioning apparatus 114 may be secured to the patient table 110 with a clamp or other fastener, or may be stabilized and held above the table top 118 by legs which are configured to contact and provide resistance against the table top 118.

Figure 4:
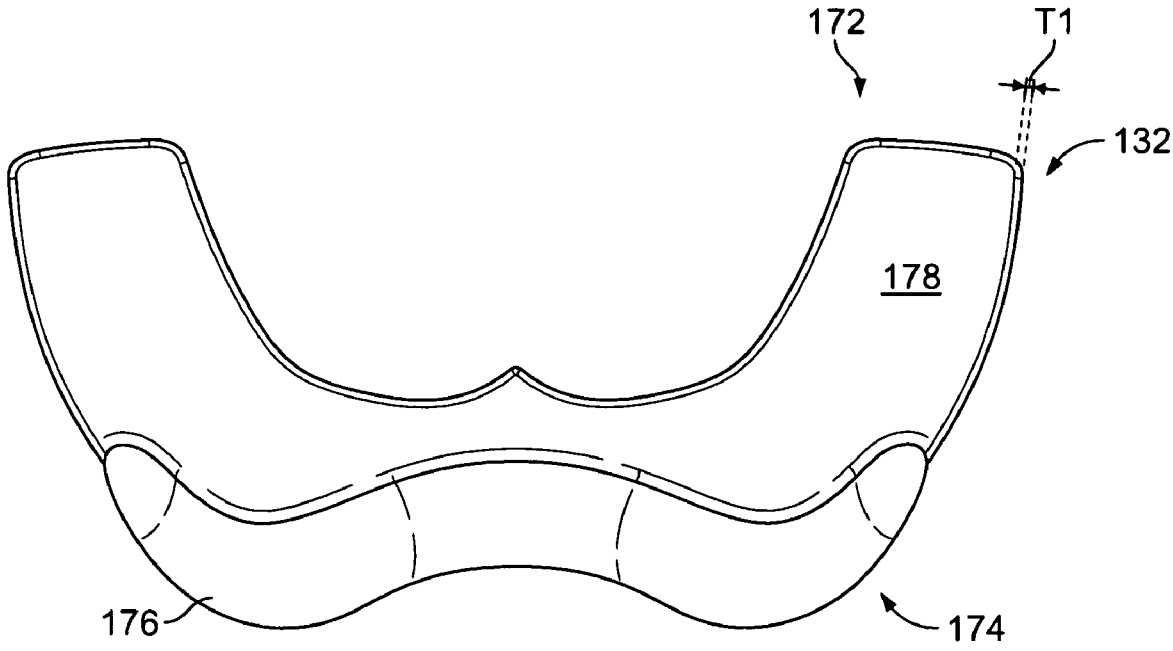
FIG. 4 illustrates the arm cushion of FIG. 2 which is placed on the arm support of the support shell in accordance with an embodiment of the present invention.

FIG. 4 illustrates the arm cushion 132 of FIG. 2 which is placed within the tray 170 of the arm support 164 of the support shell 130. The arm cushion 132 may be attached and/or fastened to the arm support 164 as discussed previously with regard to the head cushion 134. The arm cushion 132 has a rear edge 172 and a front edge 174. An elbow and forearm support 178 extends from the rear edge 172 towards the front edge 174 with a thickness T1 which may be uniform throughout. A hand rest 176 protrudes upward towards the patient table 110 from the elbow and forearm support 178 to provide a "gripping area" for the patient 108. Optionally, the thickness T1 may be varied or arm cushions 132 having different uniform thicknesses T1 may be provided. For example, an arm cushion 132 with a larger thickness T1 may be desirable for a smaller patient 108 who has relatively shorter upper arms 124, while an arm cushion 132 with a smaller thickness T1 may be desirable for a larger patient 108 who has relatively longer upper arms 124.

Figure 5:
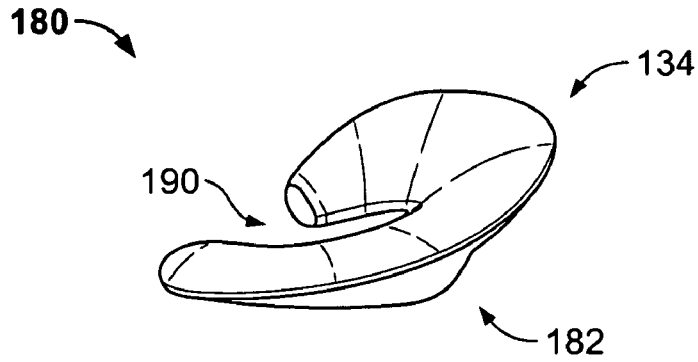
FIG. 5 illustrates the substantially C-shaped head cushion of FIG. 2 which is placed on the head support of the support shell in accordance with an embodiment of the present invention.

FIG. 5 illustrates the substantially C-shaped head cushion 134 of FIG. 2 which is placed on the head support 142 of the support shell 130. The head cushion 134 is contoured to provide cushioned support to the forehead and sides of the patient's head 120. The weight of the head 120 is distributed and equally supported along the head cushion 134. An opening 190, corresponding with the opening 140 of the head support 142 (FIG. 3), allows room for the patient 108 to breathe.

Figure 6:
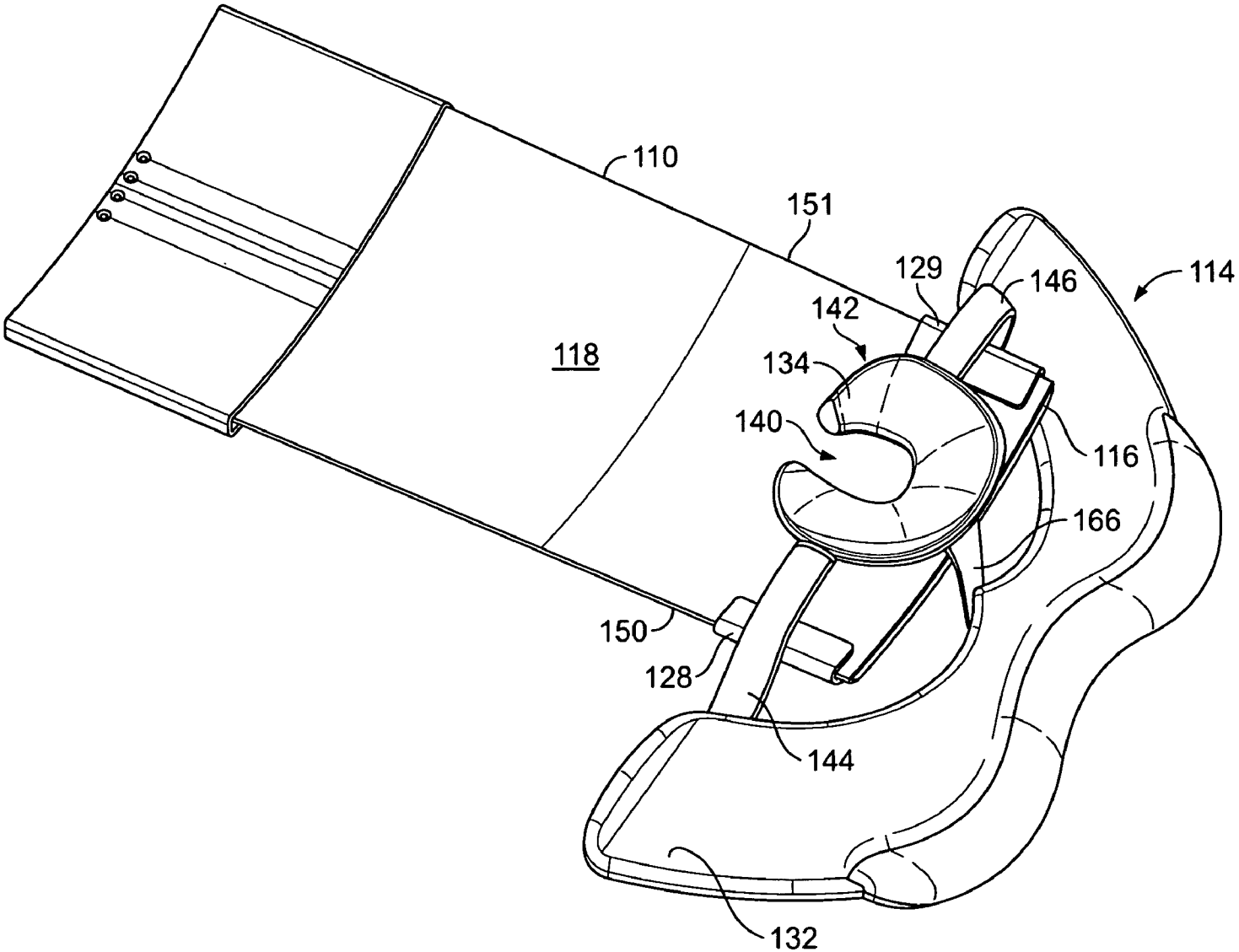
FIG. 6 illustrates the prone patient positioning apparatus mounted on the patient table in accordance with an embodiment of the present invention.

FIG. 6 illustrates the prone patient positioning apparatus 114 mounted on the patient table 110. The first and second slides 128 and 129 slide over the opposite side edges 150 and 151 of the patient table 110 proximate the first end 116. The positioning apparatus 114 may be pushed onto the patient table 110 until the first and second slides 128 and 129 are fully on the patient table 110 and/or when the center leg 166 contacts the first end 116. The first and second slides 128 and 129 are located on the first and second legs 144 and 146 such that the head support 142 is elevated above the table top 118, allowing room for the patient 108 to breathe. Alternatively, the first and second slides 128 and 129 may be removed and blocks of material such as wood, metal or plastic may be positioned between the top portions 152 and 154 and the table top 118. The blocks of material may be formed of different thicknesses to elevate the head support 142 greater or lesser distances above the table top 118.

The following discussion refers also to FIG. 1. The patient 108 lies on the patient table 110 in a prone position, placing the patient's face on the head cushion 134. The patient's nose and mouth are positioned within the opening 140 and the patient 108 can breathe normally as well as see light from the surrounding area.

The patient's torso and legs are supported by the patient table 110 while the patient's arms 122 are allowed to drop down below the patient table 110, which is a comfortable, forward position with respect to the shoulders, neck and back of the patient 108. The patient 108 rests their forearms 126 on the arm cushion 132 and their hands 127 on the hand rest 176. The hand rest 176 protrudes upward and is curved to support and allow a natural ergonomic curve of the patient's hands 127 and fingers. The arm cushion 132 extends beyond the side edges 150 and 151 of the patient table 110 to accommodate various sized patients 108. The hand rest 176 extends along the front end 182 of the positioning apparatus 114. Therefore, the patient 108 may adjust the position of their body to be customized and comfortable, minimizing the stress and strain placed on their neck, back and shoulders.

The soft material of the arm cushion 132 and head cushion 134 comfortably support the patient's head 120, forearms 126 and hands 127. The arm and head cushions 132 and 134 compress in areas that receive weight, creating indentations representative of the patient's anatomy. Therefore, the arm and head cushions 132 and 134 mold and contour to the individual curves and shape of the patient's head 120, forearms 126 and hands 127. The patient 108 is thus held and stabilized by the arm and head cushions 132 and 134 within the indentations to help prevent movement during the scan.

While the invention has been described in terms of various specific embodiments, those skilled in the art will recognize that the invention can be practiced with modification within the spirit and scope of the claims.

What is claimed is:

1. A patient positioning apparatus to support a patient in a prone position on a patient table during a diagnostic imaging scan, the patient table having a patient support surface where the patient lies in the prone position, the patient table extending lengthwise between a pair of ends and widthwise between opposite sides, the patient positioning apparatus comprising:

a head support configured to be removably mounted to the patient table and substantially suspended over the support surface of the patient table, at least a portion of the head support being above the patient table and between the pair of ends and the pair of sides, the head support supporting a patient's head above the support surface when the patient lies on the patient table in a prone position; and an arm support joined to the head support, the arm support configured to extend along the opposite sides of the patient table, the arm support being located below the head support and the patient table to support a patient's forearms below the head support.

2. The patient positioning apparatus of claim 1, further comprising:

first and second legs joining the head support and the arm support, the first and second legs extending between the head support and the arm support and being shaped to hold the head support over the support surface.

3. The patient positioning apparatus of claim 2, wherein the support surface has a perimeter defined by side edges of the patient table and the patient table has a thickness that extends between the support surface and a bottom surface, each of the first and second legs including a slide that is shaped to receive and grip a corresponding side edge, the corresponding side edge sliding through and along the corresponding slide when the legs are mounted to the patient table.

4. The patient positioning apparatus of claim 1, wherein the head support further comprises a curved face support having an opening in the center thereof, the curved face support configured to contact a portion of the patient's head, the opening positioned to allow a breathing space between the patient and the patient table.

5. The patient positioning apparatus of claim 1, further comprising at least first and second legs interconnecting the head support and the arm support, each of the first and second legs further comprising a top portion and a side portion joined with a bend, the top portions extending from opposite sides of the head support and in opposite directions with respect to each other, each top portion extending to a corresponding bend, each side portion extending from the corresponding bend at an angle with respect to the corresponding top portion, the side portions extending a length to separate the head support and the arm support.

6. The patient positioning apparatus of claim 1, further comprising a head cushion covering a top surface of the head support, the head cushion providing a contact surface for portions of the patient's head.

7. The patient positioning apparatus of claim 1, further comprising an arm cushion covering a top surface of the arm support, the arm cushion being formed of a material having at least one of compression and memory properties, the arm cushion forming an indentation which conforms to a shape of the patient's forearms.

8. The patient positioning apparatus of claim 1, further comprising head and arm cushions being removably attached to the head support and arm support, respectively.

9. The patient positioning apparatus of claim 1, the arm support further comprising a hand rest formed proximate a front end of the arm support, the hand rest being curved and extending toward the head support.

10. A patient positioning apparatus to support a patient in a prone position on a patient table during a diagnostic imaging scan, the table having a patient support surface that is defined by side edges of the table, the patient positioning apparatus comprising:

a head support supporting a patient's head above the support surface of the patient table;

an arm support supporting a patient's arms below the head support; and first and second legs interconnecting the head support and the arm support, the first and second legs extending laterally outward from sides of the head support in opposite directions, the first and second legs then extending to the arm support located below the head support;

wherein the first and second legs extend downward from a position above the patient table to a position below the patient table.

11. The patient positioning apparatus of claim 10, further comprising a head cushion and an arm cushion covering top surfaces of the head support and the arm support, respectively, the head and arm cushions compressing under the patient's head and the patient's arms to form indentations therein for holding the patient.

12. The patient positioning apparatus of claim 10, further comprising first and second slides mounted to the first and second legs, respectively, the first and second slides each having a top portion that is configured to be removably mounted onto the support surface, the top portion being sized and shaped to stabilize the head support and the arm support with respect to the patient table.

13. The patient positioning apparatus of claim 10, the head support further comprising a curved face support having an opening in the center thereof, the curved face support configured to contact a portion of the patient's face, the opening providing room for the patient to breathe.

14. The patient positioning apparatus of claim 10, wherein the arm support curves about an end of the patient table that is proximate to the head of the patient when the patient is in the prone position, the arm support extending between and along opposite sides of the table.

15. The patient positioning apparatus of claim 14, wherein the first and second legs attach to the arm support along a common interior edge of the arm support.

16. The patient support apparatus of claim 10 further comprising a third leg that holds the head and arm supports with respect to each other.

17. The patient positioning apparatus of claim 10 wherein the head support has a bottom surface, the bottom surface being spaced apart from the support surface of the patient table when supporting the patient's head thereabove.

18. A patient positioning apparatus to support a patient in a prone position on a patient table during a diagnostic imaging scan, the table having a patient support surface that is defined by side edges of the table, the patient positioning apparatus comprising:

a head support supporting a patient's head above the support surface of the patient table;

an arm support supporting a patient's arms below the head support;

first and second legs interconnecting the head support and the arm support, the first and second legs extending laterally outward from sides of the head support in opposite directions, the first and second legs then extending to the arm support located below the head support; and first and second slides mounted to the first and second legs, respectively, the first and second slides each having a top portion that is configured to be removably mounted onto the support surface, the top portion being sized and shaped to stabilize the head support and the arm support with respect to the patient table.

19. The patient positioning apparatus of claim 18, further comprising an arm cushion covering the arm support.

20. The patient positioning apparatus of claim 18, the arm support further comprising a hand rest formed proximate a front end of the arm support, the hand rest being curved and extending toward the head support.

21. The patient positioning apparatus of claim 18, further comprising a head cushion and an arm cushion covering top surfaces of the head support and the arm support, respectively, the head and arm cushions compressing under the patient's head and the patient's arms to form indentations therein for holding the patient.

22. The patient positioning apparatus of claim 18 wherein the head support has a bottom surface, the bottom surface being spaced apart from the support surface of the patient table when supporting the patient's head thereabove.

* * * * *

UNITED STATES PATENT AND TRADEMARK OFFICE

CERTIFICATE OF CORRECTION

PATENT NO. : 7,603,730 B2
APPLICATION NO. : 11/481627
DATED : October 20, 2009
INVENTOR(S) : Deborah Ruth Zelnik It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 490 days.

Signed and Sealed this

Fifth Day of October, 2010

David J. Kappos

David J. Kappos
*Director of the United States Patent and Trademark Office*